United States Patent [19]

McFarlin et al.

[11] Patent Number: 5,046,634

[45] Date of Patent: Sep. 10, 1991

[54] DRUM LINER ASSEMBLY

[75] Inventors: George P. McFarlin, El Toro; Chester Savage, Irvine, both of Calif.

[73] Assignees: Scholle Corporation, Irvine, Calif.; PRB Industries, Inc., Sutton, Mass.

[21] Appl. No.: 465,383

[22] Filed: Jan. 16, 1990

[51] Int. Cl.[5] ..... B65D 25/20

[52] U.S. Cl. ..... 220/465; 220/404

[58] Field of Search ..... 220/404, 403, 470, 5 R

[56] References Cited

U.S. PATENT DOCUMENTS

| | | | |
|---|---|---|---|
| 3,169,690 | 2/1965 | Scholle | 220/465 X |
| 3,226,002 | 12/1965 | Walker | 220/465 X |
| 3,262,628 | 7/1966 | Heisler et al. | 220/465 X |
| 3,437,231 | 4/1969 | Carpenter, Jr. | 220/465 X |
| 4,164,304 | 8/1979 | Roberson | 220/465 |
| 4,635,814 | 1/1987 | Jones | 220/465 X |

*Primary Examiner*—Steven M. Pollard

*Attorney, Agent, or Firm*—Curtis, Morris & Safford

[57] ABSTRACT

A flexible drum liner assembly having a fitting which mates with a specially cut hole in the lid of the drum. The fitting of a preferred embodiment of the present invention has a mouth with internal and external threads. A standard externally threaded bung hole cover fits in the mouth and mates with its external threads. A vertical slot is cut on either side of the mouth of the fitting interrupting the external threads. A circular bung hole with two opposed inwardly directed tabs is cut into the lid of the drum. The two tabs act as keys and fit into the keyways defined by the vertical slots on either side of the mouth of the fitting.

19 Claims, 3 Drawing Sheets

DRUM LINER ASSEMBLY

FIELD OF THE INVENTION

The present invention relates to drum liners and more particularly to an improved drum liner assembly for maintaining materials away from the internal walls of a drum.

BACKGROUND OF THE INVENTION

Industrial drums made of steel and fiberboard are commonly used to transport flowable materials from place to place. When such drums are used without liners, the drums must be cleaned before re-use or disposed of. If a drum is used with a toxic or hazardous material, the disposal of the drum becomes a problem as it cannot simply be placed in normal landfill. Still further, over time, unlined drums are susceptible to corrosion, raising the risk of a spill of the drum's contents.

In order to overcome these problems, both rigid and flexible plastic liners have been proposed. Rigid liners, as described in U.S. Pat. No. 4,712,711, may be used when extremely corrosive or toxic materials are transported and the assembled drum must be able to withstand a substantial drop. Flexible liners may be employed for most other purposes to maintain material away from the internal walls of the drum (See e.g., U.S. Pat. Nos. 4,635,814, 3,409,201, 3,262,628, 3,215,307, 3,167,210 and co-pending applications Ser. Nos. 07/428,469, and 07/428,464).

One important factor in the use of flexible drum liners is the manner in which the liner is mated to a hole ("bung hole") in the lid of the drum. This is because the insertion of the bag in the drum is critical to proper functioning of the package during filling and shipment. Many previous liners have accomplished this mating by using the cap receiving threads common to most bung holes (See e.g. U.S. Pat. No. 2,987,216). With this technique, the liner is subject to twisting in the drum. In order to overcome this problem, a number of fittings which protrude through secondary holes cut in the lid of the drum have been employed (see e.g. U.S. Pat. No. 4,635,814). This requires at least a second seal in the flexible liner and frequently, a second non-vent hole cut into the drum lid. In such systems, the possibility of leaks and/or ruptures is greatly increased.

SUMMARY OF THE INVENTION

Accordingly, it is an object of the present invention to provide a system and method for overcoming problems associated with prior drum liner assemblies.

Another object of the present invention is to provide a drum liner assembly having a main fitting which prevents the twisting of the liner in the drum.

A further object of the present invention is to provide a flexible drum liner that is economical and easy to use.

In accordance with the present invention there is provided a drum liner assembly having a fitting which mates with a specially cut hole in the lid of a drum.

The fitting of a preferred embodiment of the present invention has a mouth with internal and external threads. A standard externally threaded bung hole cover fits in the mouth and mates with its internal threads. A vertical slot is cut on either side of the mouth of the fitting interrupting the external threads.

A circular bung hole with two opposed inwardly directed tabs is cut into the lid of the drum. The two tabs act as keys and fit into the keyways defined by the vertical slots on either side of the mouth of the fitting. This interaction prevents the fitting, and consequently the liner, from twisting in the drum.

The fitting, which is attached by heat sealing to the flexible liner, is inserted into the bung hole from underneath. (This requires the lid to be initially free from the rest of the drum.) A shoulder, located below the external threads of the mouth, provides a support for a gasket which abuts the bottom of the drum lid. A threaded ring engages the external rings of the mouth and the top of the drum lid. Torque is applied to the ring to bring the gasket into engagement with the bottom of the lid to thereby lock the fitting into the lid.

When the fitting is locked into place, the bag is placed into the drum and the lid is attached. The bag is preexpanded with a high pressure air line to make sure the bag fills without creasing. The vent on the lid is then closed. This prevents the bag from collapsing. The bung hole cover is then threaded into the mouth of the fitting.

When all the product has been removed from the bag, if the lid is removable, the bag can be removed by unthreading the ring. The bag can then be thrown away and the drum can be reused.

No other previous drum liner has combined the simplicity, ease of use and low cost inherent in the present invention. The unitary construction of the fitting and the simple locking arrangement provide for an exceptionally effective drum liner assembly.

DETAILED DESCRIPTION

Figure 1:
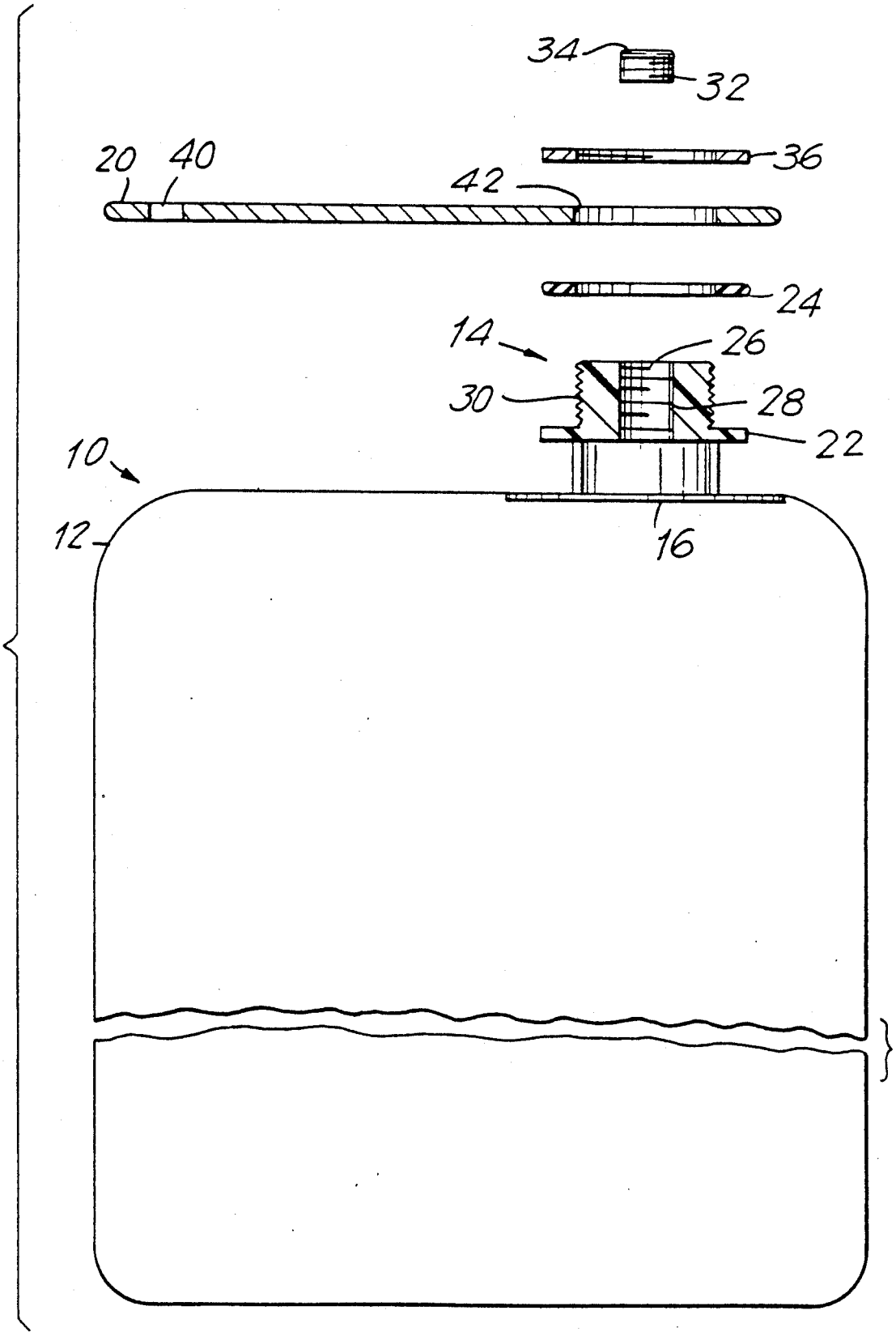
FIG. 1 is an exploded elevational view of a preferred embodiment of the present invention showing the interaction between a bung cover, a hold down ring, a drum cover, a gasket and a drum liner fitting.
Figure 2:
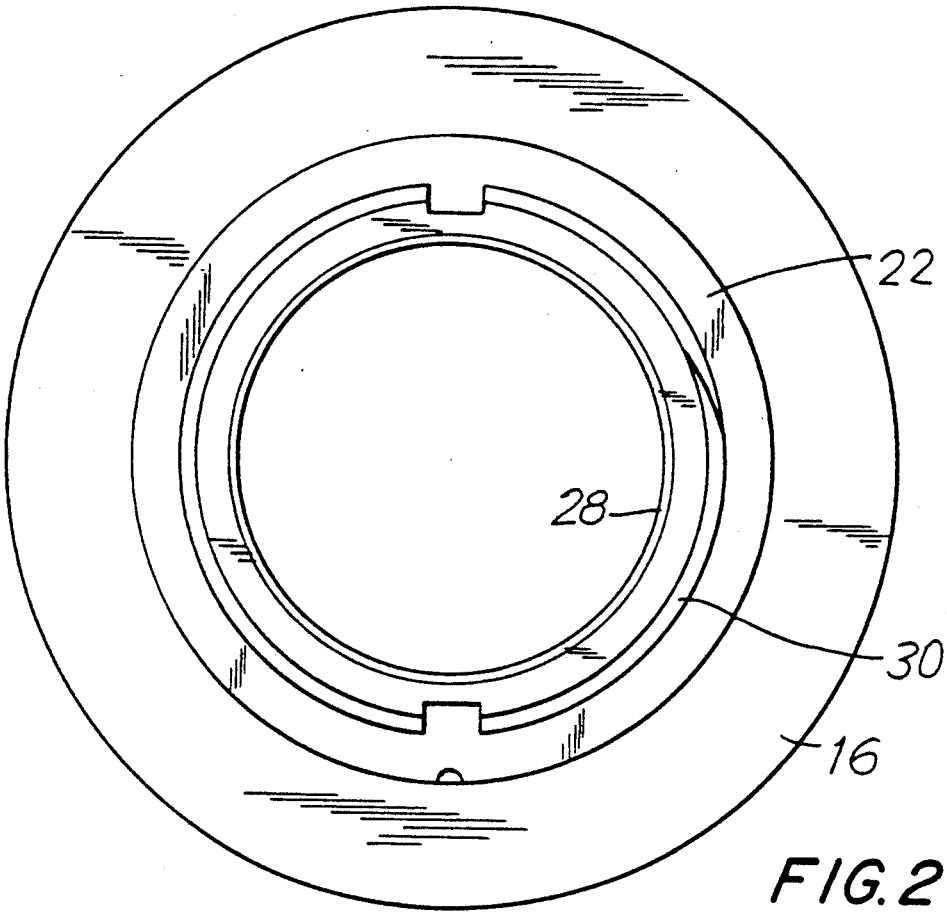
FIG. 2 is a top plan view of a preferred embodiment of the fitting of the present invention.
Figure 3:
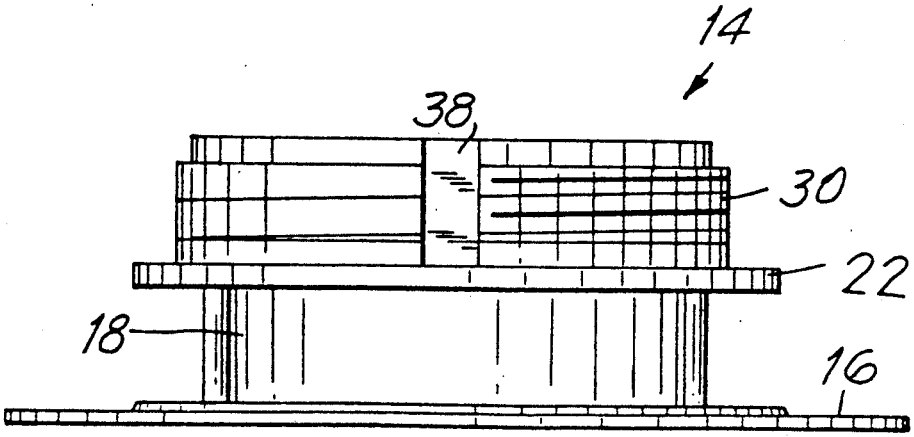
FIG. 3 is a side elevational view of a preferred embodiment of the fitting of the present invention.
Figure 4:
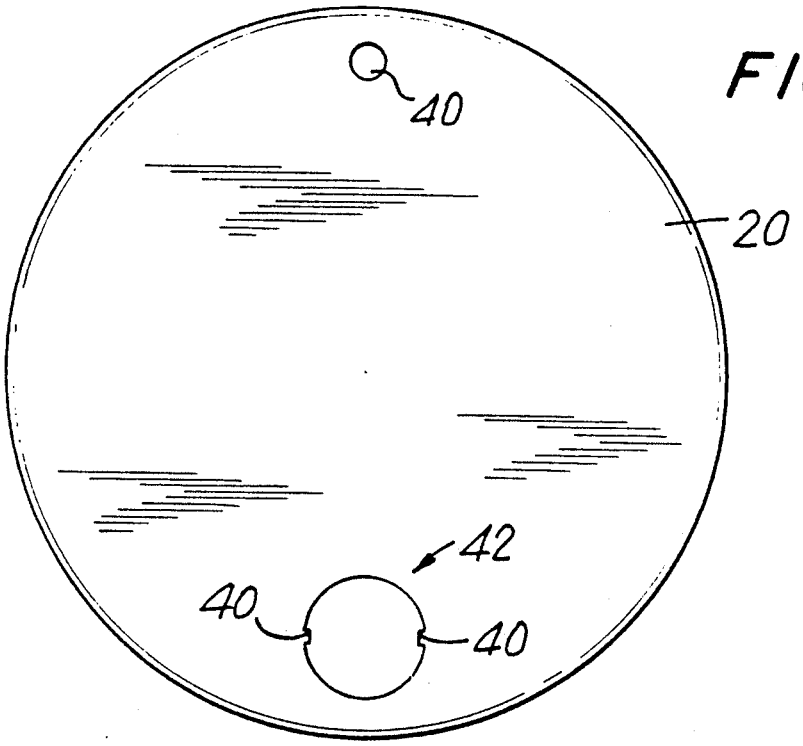
FIG. 4 is a top plan view of a drum lid having a bung hole and vent cut in accordance with a preferred embodiment of the present invention.
Figure 5:
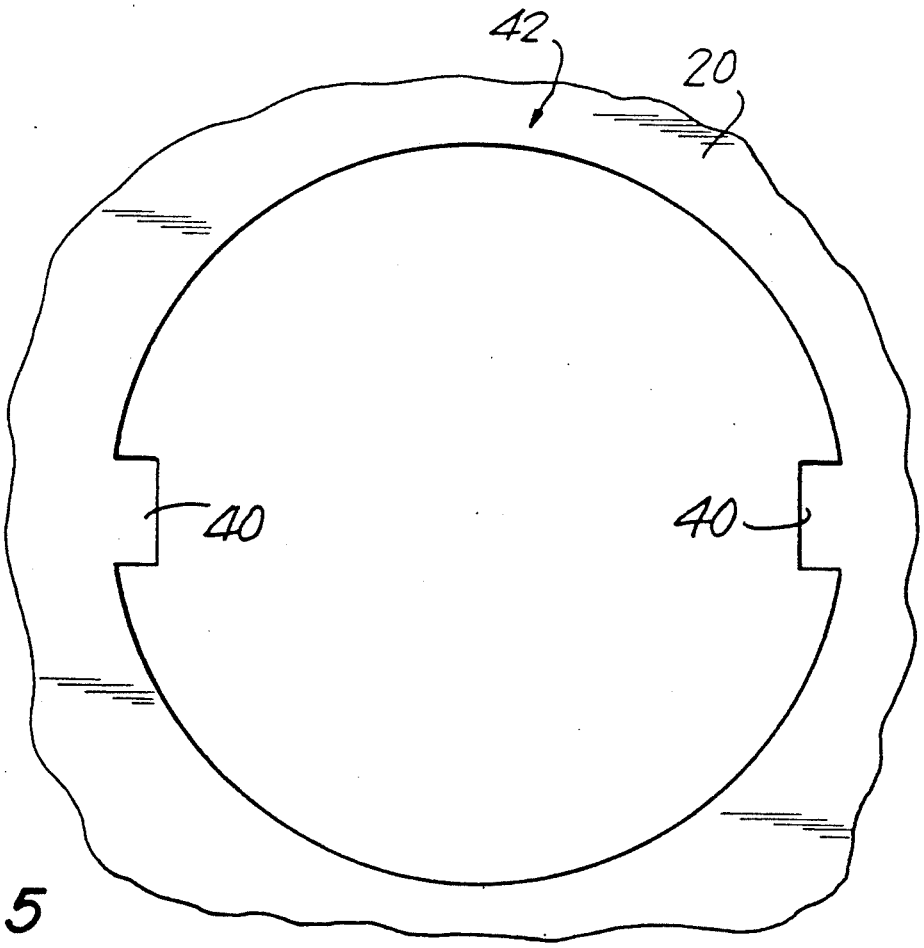
FIG. 5 is a top plan view of the bung hole cut in the drum lid in accordance with a preferred embodiment of the present invention.

The drum liner 10 of the present invention has a bag 12 preferably having one or more plies of low density polyethylene and/or nylon film in the range of approximately 2–10 mils thick. Best results have thus far been obtained with an inner ply of approximately 4 mils and an outer ply of approximately 4 mils thick. This structure yields superior flex crack and chemical resistance. (While the aforementioned structure is preferred, any inert, non-corrosive, flexible material of sufficient thickness may be used. Still further, the recitation of only two plies should not be construed as limiting the number of plies which can be employed.) The film employed in constructing the bag is heat sealed around the edges to form a bag which has a fluid tight, strong seal.

In one preferred embodiment of the present invention, the bag 12 is substantially rectangular in shape. In another embodiment of the present invention, the bag 12 has the corners sealed off. Since stored product can get caught in the corners of the bag, this configuration assures the complete removal of the product.

A fitting 14 is preferably heat sealed to the bag 12 at a bottom mounting ring 16. The fitting 14 is preferably located at one short end of the bag, off-set from the center. The fitting is the only opening in the bag 12.

A rigid support spacer 18 is integral with the bottom mounting ring 16 and extends above it. The purpose of the spacer 18 is to provide clearance between the bag 14 and the drum lid 20, when the lid 20 is affixed to an industrial drum (not shown). This prevents the bag 12 from getting caught in the seal between the drum and the lid 20.

A circumferential shoulder 22 is above and integral with the spacer 18. The shoulder 22 provides support for a gasket 24. The underside of lid 20 is brought into contact with the gasket 24 such that the shoulder 22 acts as a structure for holding the drum liner 10 in place on the lid 20.

Above the shoulder 22 is the mouth 26 of the fitting 14. The mouth 26 has internal threads 28 and external threads 30. The internal threads 28 mate with external threads 32 of a bung cover 34. The external threads of the mouth 26 mate with a threaded ring 36.

The bung cover 34 is preferably of the normal type used to fit in a standard threaded bung hole of an industrial drum. The cover 34 is threaded into the mouth 26 to effectively seal any stored product in the drum liner 10. It is simply unscrewed when it is desired to remove material from the drum.

When the liner 10 is employed, the fitting 14 is pushed through the lid 20 through a bung hole 42. The threaded ring 36 is fit on the external threads 30 of the mouth 26 to lock the drum liner 10 on the lid 20. The ring 36 is screwed down on the external threads 30 until it abuts the lid 20. Additional torque is then applied as needed to prevent the ring 36 from loosening.

Two vertical key slots or keyways 38 are cut on either side of the mouth 26 of the fitting 14. These keyways 38 completely interrupt the external threads 30 of the mouth 26. However, this interruption does not effect the mating of the ring 36 to the external threads 30. The keyways 38 are engaged by two tabs or keys 40 which protrude inwardly on either side of the bung hole 42 which is cut (punched) into the lid 22. The engagement of the keys 40 in the keyways 38 prevents the fitting 14 and consequently the entire drum liner 10, from turning.

A vent hole 40 is typically provided in the lid 22. The proper use of the vent hole 40 helps the flow of material into and out of the liner.

When the present invention is used, the gasket 24 is first placed on the shoulder 22 of the fitting 14. The mouth 26 of the fitting 14 is then inserted into the bung hole 42 of the drum lid 20 from the bottom. This is done by aligning the keyways 38 of the mouth 26 with the keys 40 of bung hole 42. The fitting 14 is pushed in through the bung hole 42 until the gasket 24 abuts the underside of the lid 20.

Next, the threaded ring 36 is screwed onto the external threads 30 of the mouth 26 which protrude through the lid 20. The ring 36 is turned down until it abuts the top of the lid 20. Additional torque is then applied to prevent the ring 36 from loosening during movement of the complete drum and liner assembly.

After the liner 10 is mated to the drum lid 20, the lid 20 is affixed to the rest of the body of the drum (not shown). This affixation may be accomplished by any known means including a ring clamp (not shown) or simple screw mechanism (not shown). It need not be permanently attached. The drum to which the lid 20 is attached can be steel, fiberboard or any other suitable material. It can be of any necessary size or configuration.

Before filling the drum and liner assembly with any material, the bag 12 is preferably pre-inflated using a high pressure air line (not shown). (Drawing a vacuum on the vent hole 40 may assist in the complete inflation of the bag 12.) When the bag 12 is fully inflated, the vent hole 40 is closed to prevent the bag from collapsing during shipment and filling. The pre-inflated 12 is less susceptible to creasing during filling. Still further, in its fully expanded state, the bag 12 abuts the interior walls of the drum. This results in less flexing of the bag 12 during shipment. Consequently, the bag will be less likely to leak.

After the bag 12 is filled with a flowable material, the externally threaded bung cover 39 is threaded into the internal threads 28 of the mouth 26 of the fitting 14. This seals the material in the drum for shipment.

While reference has been made to certain specific structure and materials, these are meant as illustrative only and one of skill in the art may alter these elements without departing from the spirit and intent of the present invention.

We claim:

1. A drum liner assembly comprising:

bag means for holding material therein;

fitting means connected to said bag means for providing access to the inside of said bag, wherein said fitting means comprises:

mounting ring means for connecting said bag means to said fitting means;

shoulder means connected to said mounting ring means for providing a support surface;

mouth means integral with said shoulder means having internal and external threads, wherein said mouth means has a plurality of vertical keyways cut through said external threads;

drum lid means supported by said shoulder means, having a bung hole cut therein, wherein said bung hole is configured with a plurality of inwardly directed keys for engaging said keyways of said mouth means;

lock ring means for mating with said external threads of said mouth means to lock said fitting means in said drum lid means; and securing means for securing said drum lid to a drum.

2. An apparatus according to claim 1, further comprising gasket means disposed between said shoulder means and said drum lid means for providing a seal between said fitting means and said drum lid means.

3. An apparatus according to claim 1, wherein said bag means comprises one or more plies in the range of approximately 2 mils to 10 mils thick.

4. An apparatus according to claim 3, wherein said bag has a first inner ply made from low density polyethylene.

5. An apparatus according to claim 4, wherein said bag has an outer ply which is a nylon film.

6. An apparatus according to claim 5, wherein said inner ply is approximately 4 mils thick.

7. An apparatus according to claim 6, wherein said outer ply is approximately 4.5 mils thick.

8. An apparatus according to claim wherein said bag is substantially rectangular in shape.

9. An apparatus according to claim 8, wherein said bag has its corners sealed off.

10. A method for preparing and filling an industrial drum comprising the following steps:

providing a drum liner with a fitting, wherein said fitting has a mouth with internal and external threads and wherein said fitting also has a plurality of keyways cut therein;

providing a drum having a removable lid, wherein said lid has a bung hole and a vent hole cut therein, and wherein said bung hole has a plurality of inwardly directed keys;

mating the keys of said bung hole with the keyways of said fitting by inserting the fitting through said bung hole from the bottom of said lid such that the mouth of said fitting extends above the top of said lid;

threading a locking ring onto said external threads of said mouth of said fitting which extends above the top of said lid;

applying enough torque on said lid to lock said fitting in said bung hole and into said lid;

attaching said drum lid to a drum body;

inflating said drum liner;

closing said vent hole;

filling said drum liner, through said fitting, with a flowable material; and threading a bung cover into said internal threads of said mouth of said fitting.

11. A method according to claim 10, comprising the additional step of placing a gasket over said fitting before inserting said fitting in said bung hole such that said gasket is in directly abutting relation with the bottom of said lid.

12. A drum liner comprising:

bag means for holding material therein;

fitting means connected to said bag means for providing access to the inside of said bag, wherein said fitting means comprises:

mounting ring means for connecting said bag means to said fitting means;

shoulder means connected to said mounting ring means for supporting a drum lid thereon;

mouth means integral with said shoulder means comprising:

internal thread means for receiving an externally threaded bung cover;

external thread means for receiving a locking ring for locking said fitting in a drum lid; and a plurality of vertical keyways cut through said external thread means for mating with a plurality of keys extending inwardly from a bung hole in a drum lid.

13. An apparatus according to claim 12, wherein said bag means comprises one or more plies in the range of approximately 2 mils to 10 mils thick.

14. An apparatus according to claim 13, wherein said bag has a first inner ply made from low density polyethylene.

15. An apparatus according to claim 14, wherein said bag has an outer ply which is a nylon film.

16. An apparatus according to claim 15, wherein said inner ply is approximately 4 mils thick.

17. An apparatus according to claim 16, wherein said outer ply is approximately 4 mils thick.

18. An apparatus according to claim 12, wherein said bag is substantially rectangular in shape.

19. An apparatus according to clam 18, wherein said bag has its corners sealed off.

* * * * *